United States Patent [19]

Tseng

[11] Patent Number: 4,951,779

[45] Date of Patent: Aug. 28, 1990

[54] MULTIUSER HIGH-RISE BUILDING FIRE ESCAPE DEVICE

[76] Inventor: Ching-Kun Tseng, No. 36, Lane 112, Ssu Yuang Rd., Hsin Chuang City, Taipei, Taiwan

[21] Appl. No.: 427,271

[22] Filed: Oct. 24, 1989

[51] Int. Cl.[5] ..... A62B 1/02

[52] U.S. Cl. ..... 182/14; 182/37; 182/38; 182/142

[58] Field of Search ..... 182/13, 14, 37, 38, 182/142, 82, 46, 47

[56] References Cited

U.S. PATENT DOCUMENTS

| | | | |
|---|---|---|---|
| 466,890 | 1/1892 | Dean | 182/37 |
| 662,875 | 11/1900 | Newburn | 182/82 |
| 665,707 | 1/1901 | Tromanhauser | 182/142 |
| 1,027,724 | 5/1912 | Haney | 182/142 |
| 1,252,438 | 1/1918 | Hoffman | 182/142 |
| 3,945,469 | 3/1976 | Dorcich | 182/142 |
| 4,074,789 | 2/1978 | Warren | 182/14 |
| 4,865,155 | 9/1989 | Montaigne | 182/82 |

FOREIGN PATENT DOCUMENTS

| | | | |
|---|---|---|---|
| 1510 | of 1912 | United Kingdom | 182/13 |

*Primary Examiner*—Reinaldo P. Machado
*Attorney, Agent, or Firm*—Varndell Legal Group

[57] ABSTRACT

A multiuser high-rise building fire escape device includes a basic bearing frame assembly alternatively mountd on the roof or either floor of a high-rise building, and several cabins mounted on the tracks of the basic bearing frame assembly and suspended therefrom through a steel rope combination. The cabins each comprises a speed reducing gear to smoothen the down stroke speed of the cabin, a motor assembly to drive the steel rope to wind up so as to lift the cabin, a mid-way stop mechanism to stop the cabin during down stroke, and a ladder door to control the access of the cabin and to serve as a bridge for striding over the cabin and an intermediate floor of a building.

12 Claims, 8 Drawing Sheets

Fig. 3
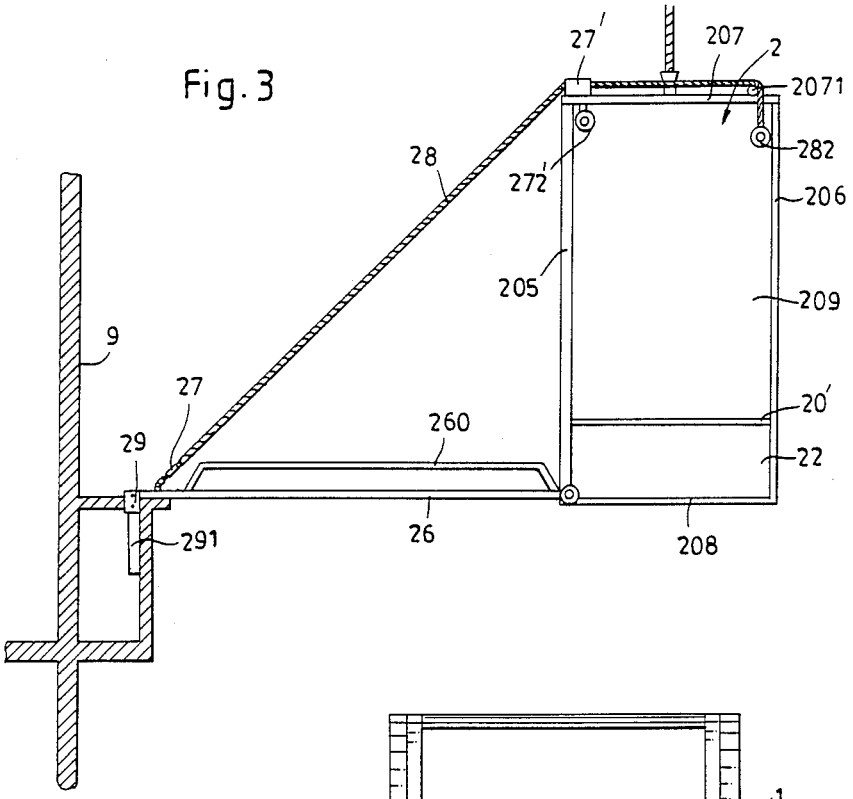
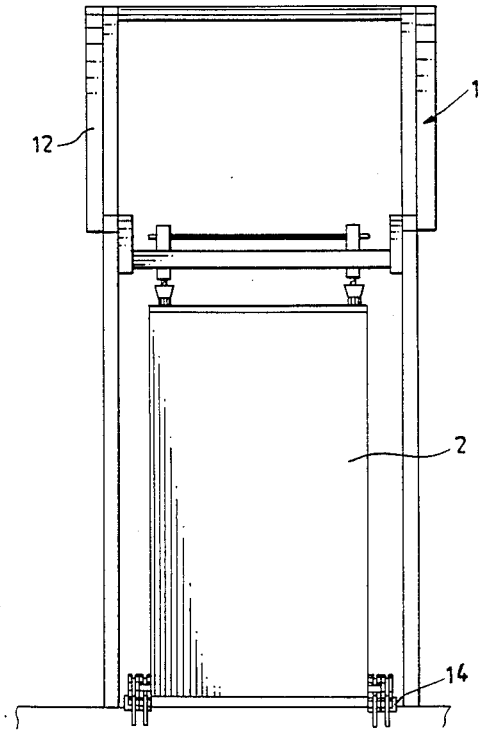
Fig. 2

MULTIUSER HIGH-RISE BUILDING FIRE ESCAPE DEVICE

BACKGROUND OF THE INVENTION

The present invention relates to a fire escape device and more particularly to a multiuser fire escape device for use to help people escape from the fire in a high-rise building whereto a regular scaling ladder can not reach.

In recent years, due to increasing of urban population and reducing of available area for construction, living space for people is getting more crowded. In order to fully utilize the limited land source in urban area, to establish high-rise building becomes one of the best ways to go. Although high-rise buildings provide more rooms for people to live, fire escape problem becomes more difficult to handle. In case a fire arises in the floors of a high-rise building whereto regular fire ladder or fire fighting equipments can not reach, catastrophe may be unable to eliminate. If to use a helicopter to help people escape from a fire in the top floors of a high-rise building, it must be very careful to protect the fuel of the helicopter from the fire. In order to solve the problems, some kinds of high-rise building fire escape carriers are used for carrying people to escape from a high-rise building. However, regular fire escape carriers normally include a simple cage driven by a single cable or suspension rope to descend from the top. During falling, the cage is difficult to control due to the effect of wind force or some other reasons (for example, unbalanced loading, losing head from fear). Further, regular fire escape carriers do not have any mechanism available to control the falling speed or to stop falling of the device for helping people. Therefore, regular fire escape carriers can not help people to escape from a fire in the intermediate floors of a high-rise building. In case a fire is arisen in intermediate floors of a high-rise building over 20–40 stories or higher, the people may be unable (because passage has been blocked up with flame, or because the roof is too far to reach within short time) to escape to the roof to ask for help. In consequence, the chance to escape from a fire may be relatively reduced.

It is, therefore, the main object of the present invention to provide such a high-rise building fire escape device which includes a basic bearing frame assembly mounted on the roof of a building having an upper track and a lower track to guide the cabins thereof to smoothly move out of the roof of the building for further down stroke to the ground so as to carry people from the fire.

Another object of the present invention is to provide such a high-rise building fire escape device which includes a mid-way stop mechanism permitting the people carried therein to stop the device during down stroke so as to help the people in intermediate floors of a building escape from fire.

Still another object of the present invention is to provide such a high-rise building fire escape device which includes a pair of steel ropes to stably suspend the cabin of the device from the basic bearing frame assembly mounted on the roof or any intermediate floor of a building and to release the cabin from the top or to lift the cabin from the bottom.

Still another object of the present invention is to provide such a high-rise building fire escape device which includes a speed reducing gear to smoothen the falling speed of the device.

Still another object of the present invention is to provide such a high-rise building fire escape device which includes a ladder door controlling the access of the cabin thereof, which ladder door may be released from the top to serve as a bridge for striding over the cabin thereof and an intermediate floor of a building.

A yet further object of the present invention is to provide such a high-rise building fire escape device which includes a motor assembly to drive a double-groove cable reel to wind up a pair of steel ropes so as to lift the cabin of the device to the top.

BRIEF DESCRIPTION OF THE DRAWINGS

FIG. 2 is a schematic front view illustrating the installation of a fire escape device of the present invention on the roof of a high-rise building;

FIG. 3 is a schematic drawing in which the ladder floor of a cabin is released to stride over a balcony of a high-rise building;

DETAILED DESCRIPTION OF THE PREFERRED EMBODIMENT

Figure 1:
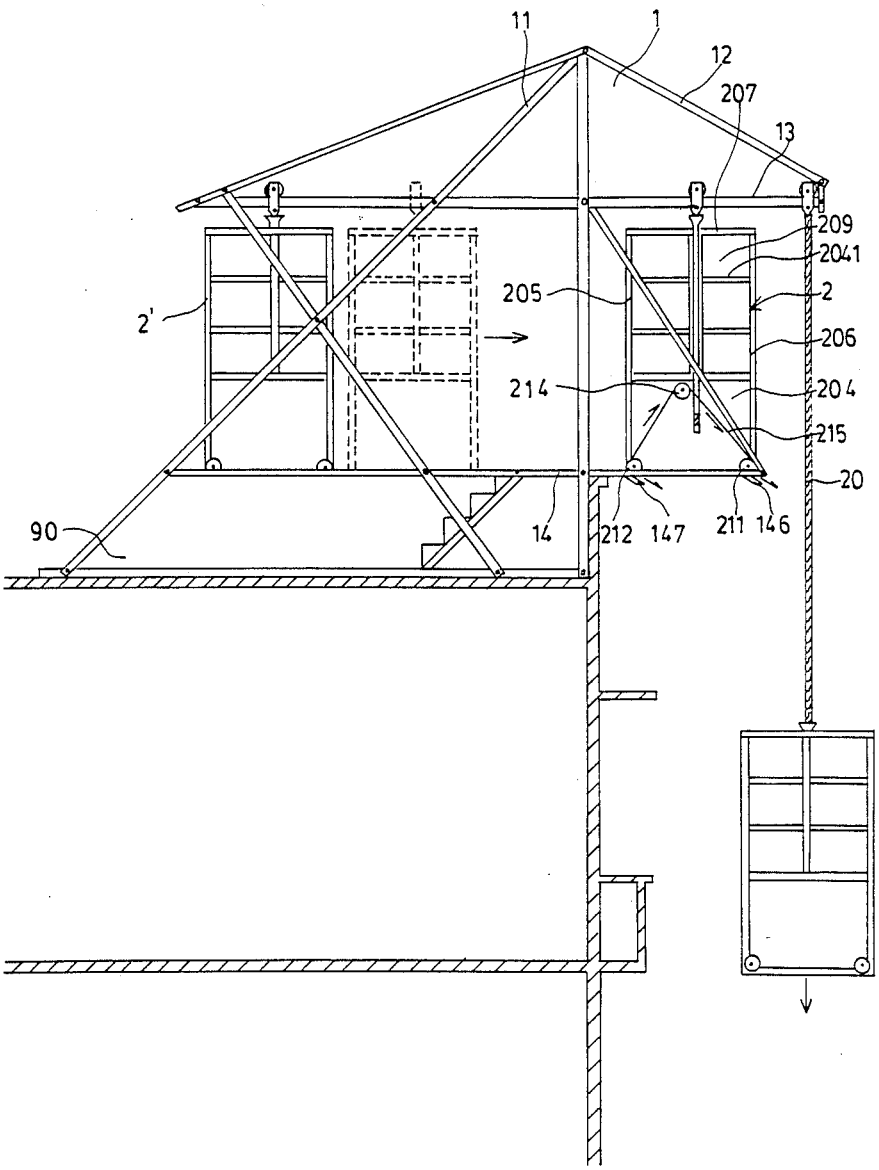
FIG. 1 is a schematic side view illustrating the installation of a fire escape device of the present invention on the roof of a high-rise building.
Figure 4:
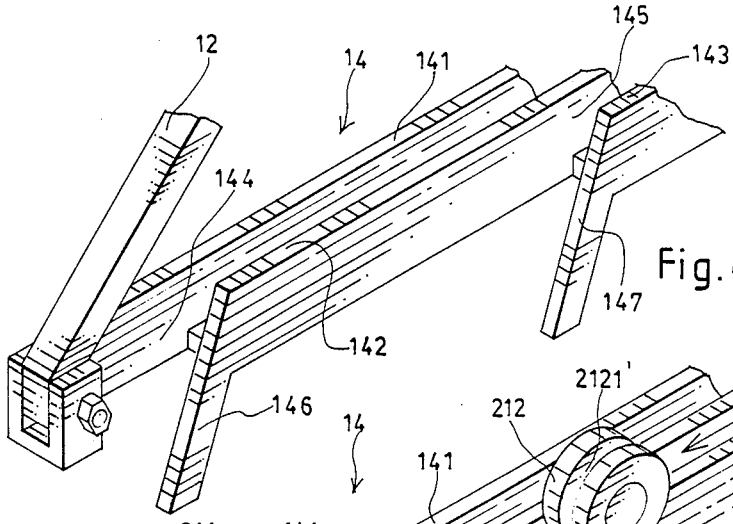
FIG. 4 illustrates the structure of the lower track of the basic bearing frame assembly of the present invention.
Figure 5:
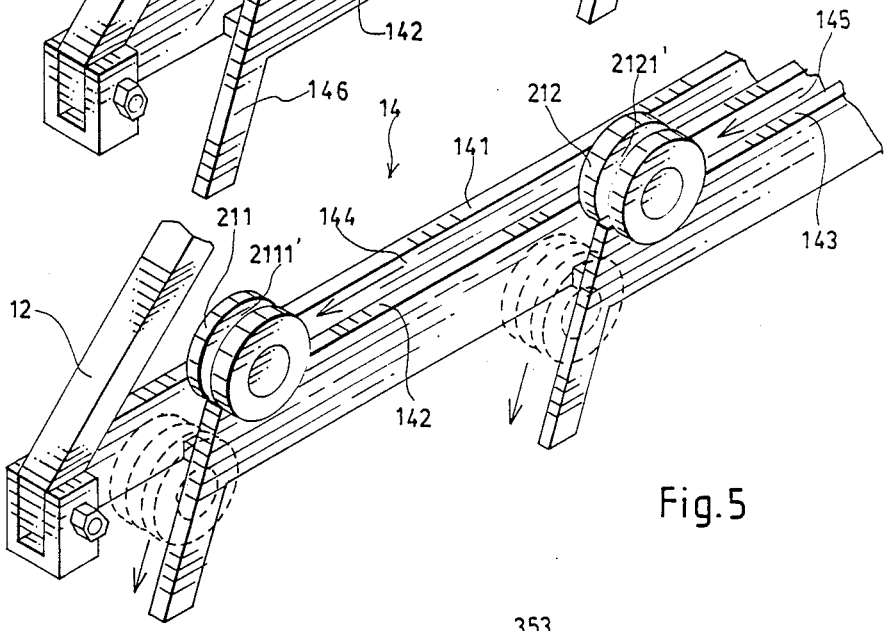
FIG. 5 is a schematic drawing illustrating the operation of the pulley wheels of a cabin on the lower track of the basic bearing frame assembly.
Figure 7:
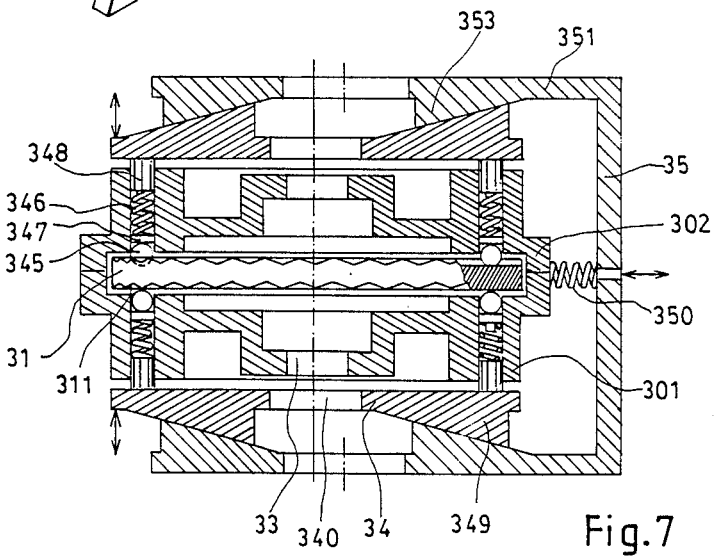
FIG. 7 is a sectional view of a speed reducing gear according to the present invention.

Turning now to the attached drawings from FIG. 1 through FIG. 6, therein illustrated is a multiuser high-rise building fire escape device embodying the present invention and generally comprised of a basic bearing frame assembly (1) fixedly mounted on the roof of a high-rise building, and several cabin (2, 2') movably mounted on the basic bearing frame assembly (1) for carrying people to escape from fire. The cabins (2,2') are respectively mounted on the tracks of the basic bearing frame assembly (1) controlled to slide thereon by means of a steel rope combination (20), each comprises a speed reducing gear (3), a motor assembly (4), and a mid-way mechanism (5).

Referring to FIGS. 1 and 2, the basic bearing frame assembly (1) includes a main frame structure comprised of several pairs of long and short rods (11, 12) respectively connected through screw joint or welding process, and fixedly mounted on the roof (90) of a high-rise building (9) at one corner. An upper track (13) and a lower track (14) are respectively mounted on the basic bearing frame assembly (1) and disposed in parallel with each other at different level. The length of the upper and lower tracks (13) and (14) may be flexibly set according to requirement. However, the upper and lower tracks (13) and (14) must be longer enough to project out of the roof (90) for a certain range to define a down stroke passage therefrom for the cabin (2). According to the present invention, the upper track (13) is a double-track line comprised of a pair of parallel rails, the lower track (14) is a double-track line including two parallel sets of rails of which each set is comprised three rails (141, 142, 143), i.e. the inner, the intermediate and the outer rail. When to mount the wheel train of a cabin (2) on the tracks (13) and (14), the wheel grooves (2111', 2121') of the pulley wheels (211, 212) are respectively mounted on the rails (13, 142, 143) of the tracks (13) and (14) (see FIGS. 4 and 5). If the pulley wheels (211, 212) of a cabin (2) are set in the channels (144, 145) of the lower track (14), the pulley wheels (211, 212) may be stuck if there is anything in the way. The lower track (14) further comprises two side rails (146, 147) downwardly extending from the rails (142, 143) at the front end to guide the cabins (2) for down stroke, wherein the turning points of the side rails (146, 147) from the rail (142, 143) are respectively made according to the range between the front and rear pulley wheels (211, 212) of the cabins (2).

Figure 6:
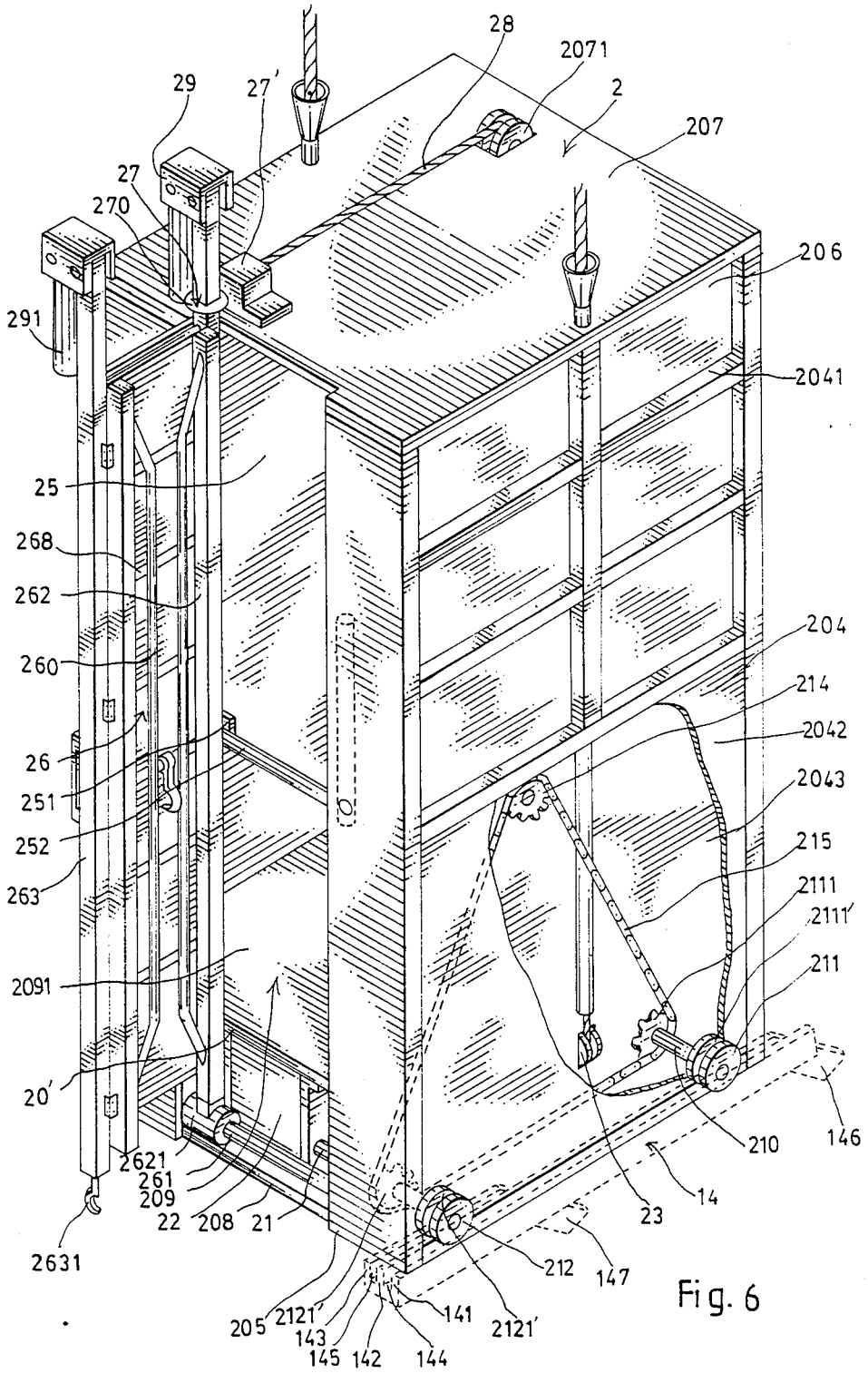
FIG. 6 illustrates the outer appearance and partly internal structure of a cabin of the fire escape device of the present invention.
Figure 12:
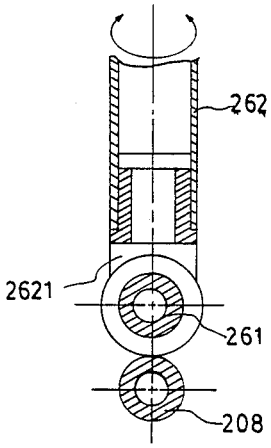
FIG. 12 is a schematic drawing illustrating the motion of horizontal rotation of the vertical shaft of the ladder door on the transverse shaft.
Figure 14:
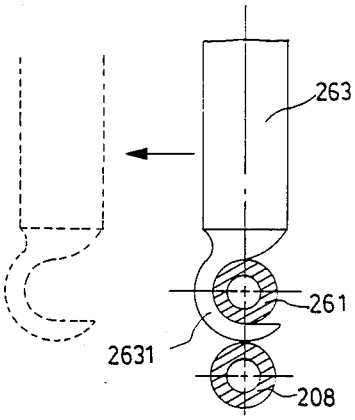
FIG. 14 is a schematic drawing illustrating the motion of the semi-circular hook end to disengage from the transverse shaft.
Figure 13:
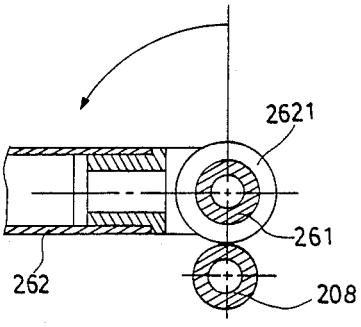
FIG. 13 is a schematic drawing illustrating the motion of vertical rotation of the vertical shaft and the connected knuckle relative to the transverse shaft.

The cabins (2) each are comprised of a pair of side wall portions (204), a front wall portion (205), a back wall portion (206), a top wall portion (207) and a bottom wall portion (208), and defining therein an inner space (209) divided by a division plate (20') into an upper person carrying chamber (2091) and a lower control room (22). The front and back wall portions (205, 206) are made of fire-resisting material in solid structure. The pair of side wall portions (204) each comprise a window frame (2041) having mounted thereon a fire-resisting window hanging (not shown), so that the fire-resisting window hanging may be rolled up for viewing outside through the window frame (2041). The lower part (2042) of each side wall portion (204) defines therein a hollow chamber (2043) for mounting wheel train. As illustrated in FIG. 6, two wheel axles (21, 210) in different size are respectively mounted in the pair of side wall portions (204) at a lower position transversely piercing therethrough, wherein the wheel axle (21) near the front wall portion (205) is shorter and made in size to match with the two inner rails (143) of the double-track line (14), the wheel axle (210) near the back wall portion (206) is longer and made in size to match with the two middle rails (142) of the double-track line (14). A pair of pulley wheels (211, 212) are respectively mounted on the wheel axle (21) as well as the wheel axle (210) at both ends. A pair of gear wheels (211, 2121) are mounted on the two wheel axles (21, 210) at one lateral side at a position in the inner side by the pulley wheels (211, 212). A gear wheel (214) is set in the hollow chamber (2043) of the same side wall portion (204) at an upper position in the mid-way between the gear wheels (2111, 2111') and manual controlled to rotate by a hand-wheel or the like (not shown) which is mounted on the same side wall portion (204) of the cabin (2) at the inner side. A closed chain (215) is mounted on the gear wheels (214, 2111, 2111') to rotate through a triangular course. Thus, the people in the cabin (2) may drive the closed chain (215) through the hand-wheel, to carry the pulley wheels (211, 212) to rotate, so as to further drive the cabin (2) to move along the upper and the lower tracks (13, 14). In the control room (22) of the cabin (2), there are co-axially mounted a speed reducing gear (3), a double-groove cable reel (6), a motor assembly (4), and a mid-way stop mechanism (5). A steel rope combination (20) is winding on the double-groove cable reel (6) and bilaterally extending outward and turning upward through a pair of guide pulleys (23), which are repectively set in the hollow chambers (2043) of the two side wall portions (204), and through a pair of hollow posts (2048), which are respectively mounted on the two side wall portions (204) of the cabin (2) in the middle, to further pass through a wheel carrier (24), which is mounted on the two parallel rails of the upper track (13), to suspend the cabin (2) from the basic bearing frame assembly (1). A ladder door (26) is mounted on the front wall portion (205) and includes a pair of vertical shafts (262, 263) defining therebetween a ladder (260) which is comprised of a solid back wall, two raised side walls and plurality of cross rods between the two raised side walls. A transverse shaft (261) is fixedly set in the access (25) spaced away from the bottom wall portion (208) and coupled with the vertical shaft (262) through a knuckle (2621). The knuckle (2621) is set at the bottom of the vertical shaft (262) permitting rotation of the vertical shaft (262) on its own axis (see FIG. 12) or against the transverse shaft (261) (see FIG. 13). An eye pin (27) which includes an eye ring (270) mounted on the vertical shaft (262) at an upper position is inserted through the horn-shaped opening (2701) into the hole (271') of a holder plate (27') mounted on the roof of the cabin (2). The holder plate (27') comprises a lock pin (274') controlled by a pull ring (272') and a spring (273') at the bottom to engage with the circular groove (271) of the eye pin (27) so as to let the eye pin (27) and the coupled vertical shaft (262) be firmly secured thereto. Through the control of the eye ring (270) and the knuckle (2621), the ladder door (26) may be rotated outward or inward to open or close the access (25) of the cabin (2). The vertical shaft (263) of the ladder door (26) comprises a semi-circular hook end (2631) at the bottom to engage with the transverse shaft (261) when the ladder door (26) is closed. Because the hook end (2631) is a semi-circular hook, it will be smoothly disengaged from the transverse shaft (261) when the ladder door (26) is pushed to open (see FIG. 14). The eye ring

Figure 15:
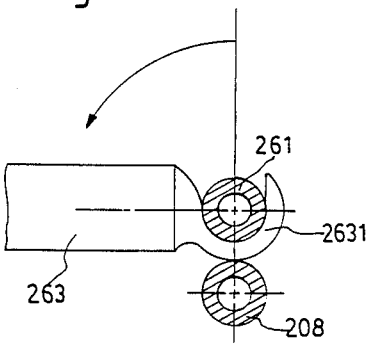
FIG. 15 illustrates the positioning of the semi-circular hook end squeezed in between the transverse shaft and the bottom wall portion of a cabin when the vertical shaft is rotated through an angle of 90° relative to the front wall portion of the cabin.

(27) has a rope (28) fixedly connected thereto, which rope (28) extends from the eye ring (27) passing through the holder plate (27') and a pulley (2071), which is mounted on the top wall portion (207), further penetrating through the top wall portion (207) into the cabin (2) to connect to a pull handle (282). Through the control of the pull handle (282), the ladder door (26) may be released to rotate downward through an angle of 90° relative to the front wall portion (205) or pulled up to close the access (25). As illustrated in FIG. 6, the vertical shaft (262) as well as the vertical shaft (263) comprises respectively an U-shaped plate (29) at the top having a pivot arm (291) connected thereto. The pivot arm (291) may be automatically turning to a position in linear to the U-shaped plate (29) through the effect of gravity, i.e. rotated through an angle of 90° relative to the vertical shaft (262) or (263) to hook on a window or balcony or the like of a building at any floor, as shown in FIG. 3, when the pull rope (28) is released to lower the ladder door (26). When the ladder door (26) is put down, the semi-circular hook end (2631) is rotated on the transverse shaft (261) and becomes firmly retained between the transverse shaft (261) and the bottom wall portion (208) (see FIG. 15). A pair of U-shaped fastening plates (251) are internally mounted on the cabin (2) in the access (25) with a cross rod (252) set therebetween, which cross rod (252) has one end fixedly connected with one of the two U-shaped fastening plates (251) and the other end detachably received in the other U-shaped fastening plate (251). The cross rod (252) partly confines the access (25) to protect persons from falling out of the cabin (2) when the ladder door (26) is open in the mid-way during down stroke. Further, the ladder door (26) may be secured to the cross rod (252) by a fastening means when it is closed.

Figure 8:
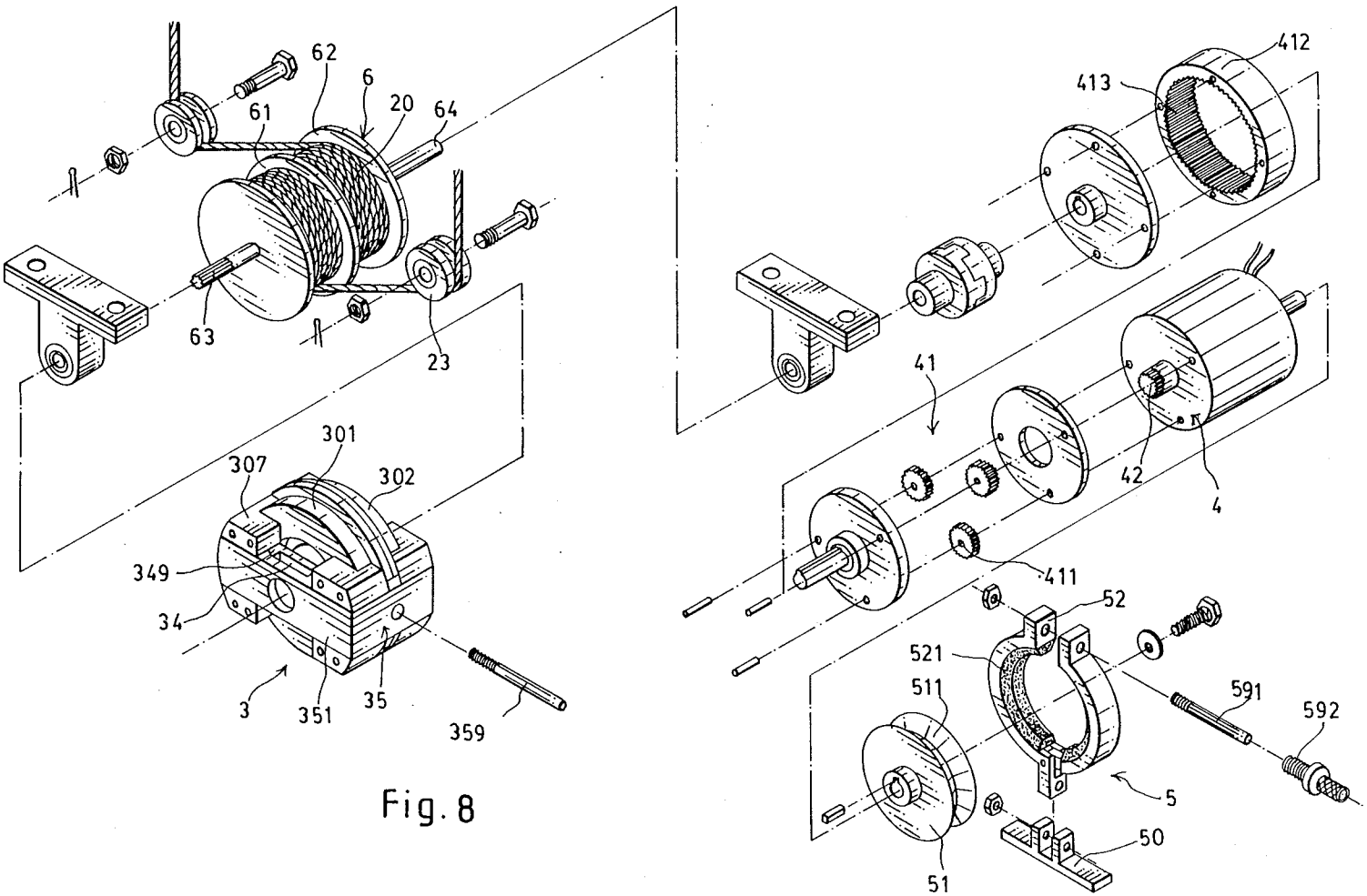
FIG. 8 is a fragmentary view illustrating structure and the relative mounting position of the cable reel, the speed reducing gear, the motor and the mid-way stop mechanism.
Figure 9:
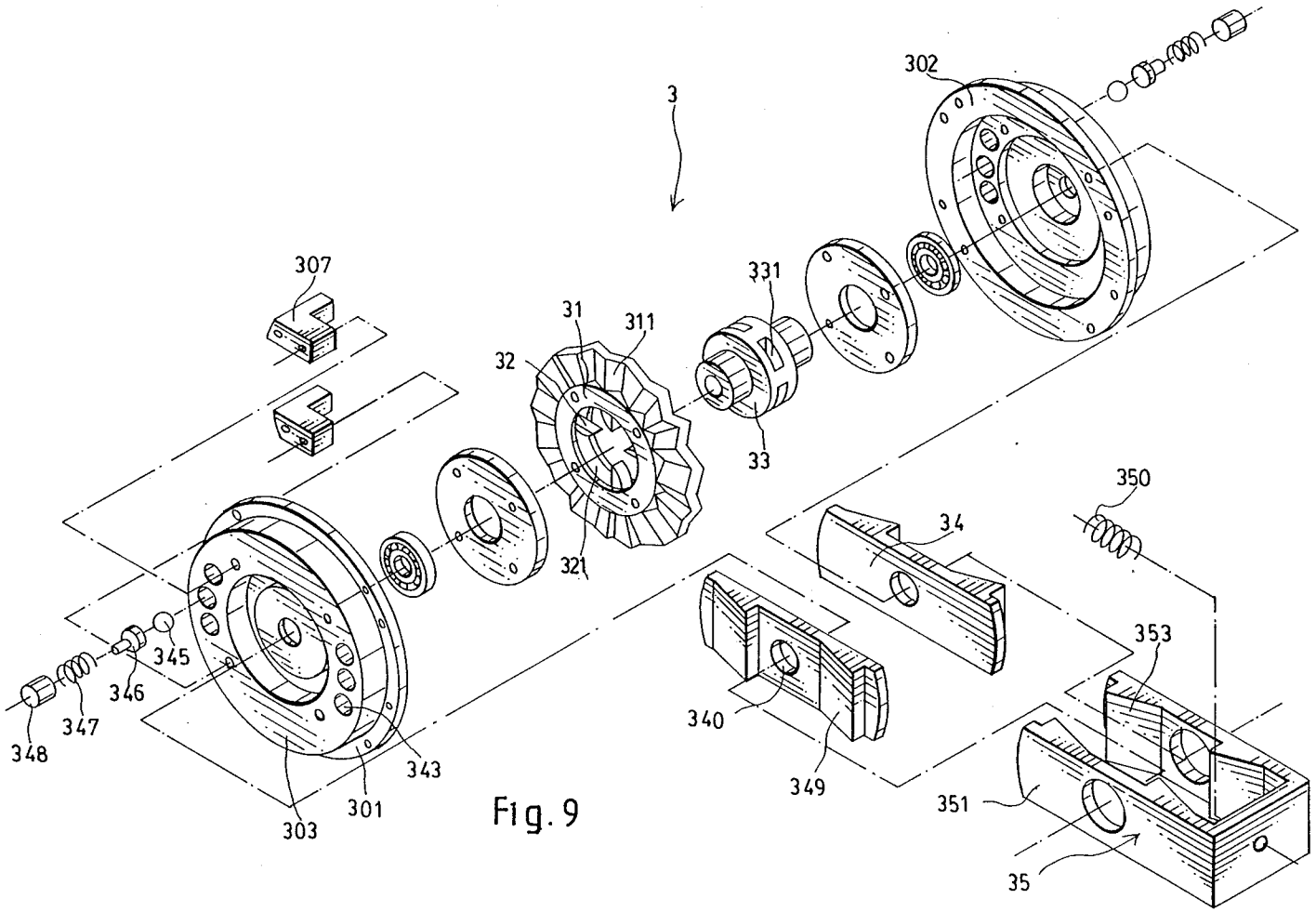
FIG. 9 is a perspective exploded view of the speed reducing gear.
Figure 10:
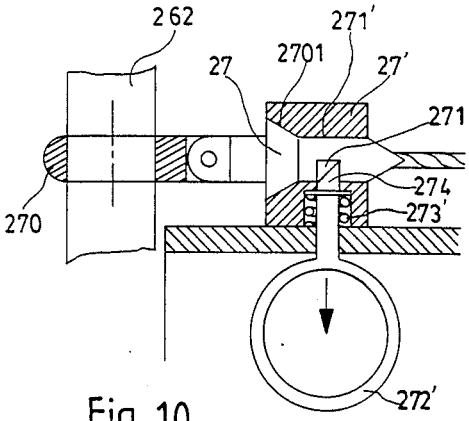
FIG. 10 is a sectional assembly view of the eye pin, the holder plate and the pull ring.
Figure 11:
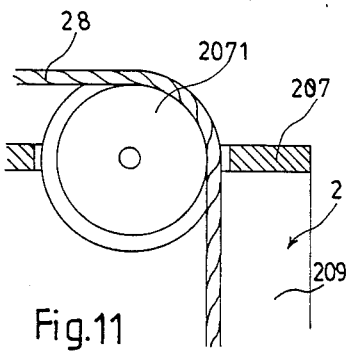
FIG. 11 illustrates the mounting of the rope which extends from the eye pin of the vertical shaft on a pulley which is set in the top wall portion of the cabin.

With respect to the operation of the speed reducing gear (3), the cable reel (6), the motor (4) and the mid-way stop mechanism (5) in the control room (22) of the cabin, please refer to FIGS. 6 and 8. The cable reel (6) includes two reel grooves (61, 62) having two steel ropes (20) of equal length (the length of the steel ropes is made according to the height of the building to install) respectively winding thereround. Following the rotation of the cable reel (6), the two steel ropes (20) are carried to wind up or wind off concomitantly. The forgoing stated pair of guide pulleys (23) are bilaterally disposed in parallel with the cable reel (6) to respectively guide the two steel ropes (20) turning upward. According to the present invention, the depth of the reel grooves (61, 62) is wider than the width of the reel grooves (61, 62) so that the steel ropes (20) can be winding round the reel grooves (61, 62) orderly. The cable reel (6) further comprises two axles (63, 64) at both ends, i.e. the front axle (63) and the rear axle (64). The speed reducing gear (3) is mounted on the front axle (63) of the cable reel (6), which is comprised of a corrugated disc plate (31) having corrugated surface (311) at both sides and four projectiles (32) in the center hole (311); a barrel (23) having four notches (331) thereon for insertion therein of the four projectiles (32) respectively; a pair of shells (301, 302) forming a housing for receiving therein the corrugated disc plate (31) and the barrel (33) and being fixedly connected to the cable reel (6) at one side by means of screw bolts, of which each comprises a flange (303) having a plurality of holes (343) thereon for setting therein respectively of a steel ball (345), a T-shaped element (346), a spring (347) and a block (348); a pair of taper plates (34) respectively mounted on the shells (301, 302) pressing on the blocks (348), of which each comprises respectively a center hole (340) and a tapered plane (349); two sets of L-shaped plates (307) (each set includes four pieces of L-shaped plates) respectively mounted on the two shells (301, 302) at the four corners; and an U-shaped holder plate (35) comprising two side arms (351) having tapered planes (353) thereon in reverse direction against the tapered planes (349) of the two taper plates (34). The U-shaped holder plate (35) is mounted on the two shells (301, 302) with the two side arms (351) respectively set in the bilateral tracks defined between the two sets of L-shaped plates (307). A fastening means (359) is made on the U-shaped holder plate (35) and connected with a spring (350) at the inner side of the U-shaped holder plate (35) for securing thereto of a pull rod (not shown) through which the person in the cabin (2) can pull and push the speed reducing gear (3). Through the effect of the spring (350) and the relative reciprocating motion of the tapered planes (353) and (349) while pulling and pushing the U-shaped holder plate (35), the steel balls (345) in the holes (343) of the two shells (301, 302) are respectively forced by the springs (347) through the T-shaped elements (346) to rub on the two corrugated faces (311) of the corrugated disc plate (31) so as to drive the barrel (33) to further reduce the revolving speed of the cable reel (6). Thus the descending speed of the cabin (2) can be controlled by the person in the cabin (2). During normal conditions, the steel balls (345) are constantly forced by the two taper plates (34) to act on the corrugated disc plate (31) to slow down the descending speed of the cabin (2) during down stroke to prevent direct dropping of the cabin (2).

The motor assembly (4) is coupled with the rear axle (64) of the cable reel (6) via a planetary gear set (41) to drive the cable reel (6) to wind up the steel ropes (20) so as to further carry the cabin (2) to move up. As illustrated, the motor assembly (4) comprises a motor shaft (42) having a toothed portion made thereon respectively engaged with three planet pinions (411). The planet pinions (411) are triangularly disposed to internally engage with the internal teeth (413) of a ring plate (412) which is fixedly connected to the cable reel (6) at the other side opposite to the speed reducing gear (3). Through the effect of the ring plate (412), a relatively bigger torque force from the motor (4) can be obtained to efficiently drive the cable reel (6) to wind up the steel ropes (20) and to drive the barrel (33) to rotate in direction free from the constrain of the projectiles (32) of the corrugated disc plate (31). Thus, the cabin (2) can be driven to move up and will not be retained by the speed reducing gear (3). The other end of the motor shaft (42) is coupled with the mid-way stop mechanism (5).

The mid-way stop mechanism (5) is comprised of a brake wheel (51) having made thereon a V-shaped circular groove (511); a pair of C-shaped brake shoe holders (52) forming a brake ring having V-shaped brake shoe (521) invertedly made thereon respectively set in the V-shaped circular groove (511) of the brake wheel (51); a base (50) fixedly set in the control room (22) for securing thereto of the brake ring; two bracing elements (591, 592) respectively screwed up with the pair of C-shaped brake shoe holders (52) with the bracing element (591) inserted into the bracing element (592) for connection thereto of a control lever (not shown) through which the pair of C-shaped brake holders (52) are pulled to squeeze the brake wheel (51) to further stop the rotation of the motor (4) so as to stop the cabin (2). Thus, the cabin (2) can be stopped whenever in down stroke, and the ladder door (26) can be released to stride over a window or balcony or the like at any floor of a building to help the people escape therefrom.

Figure 16:
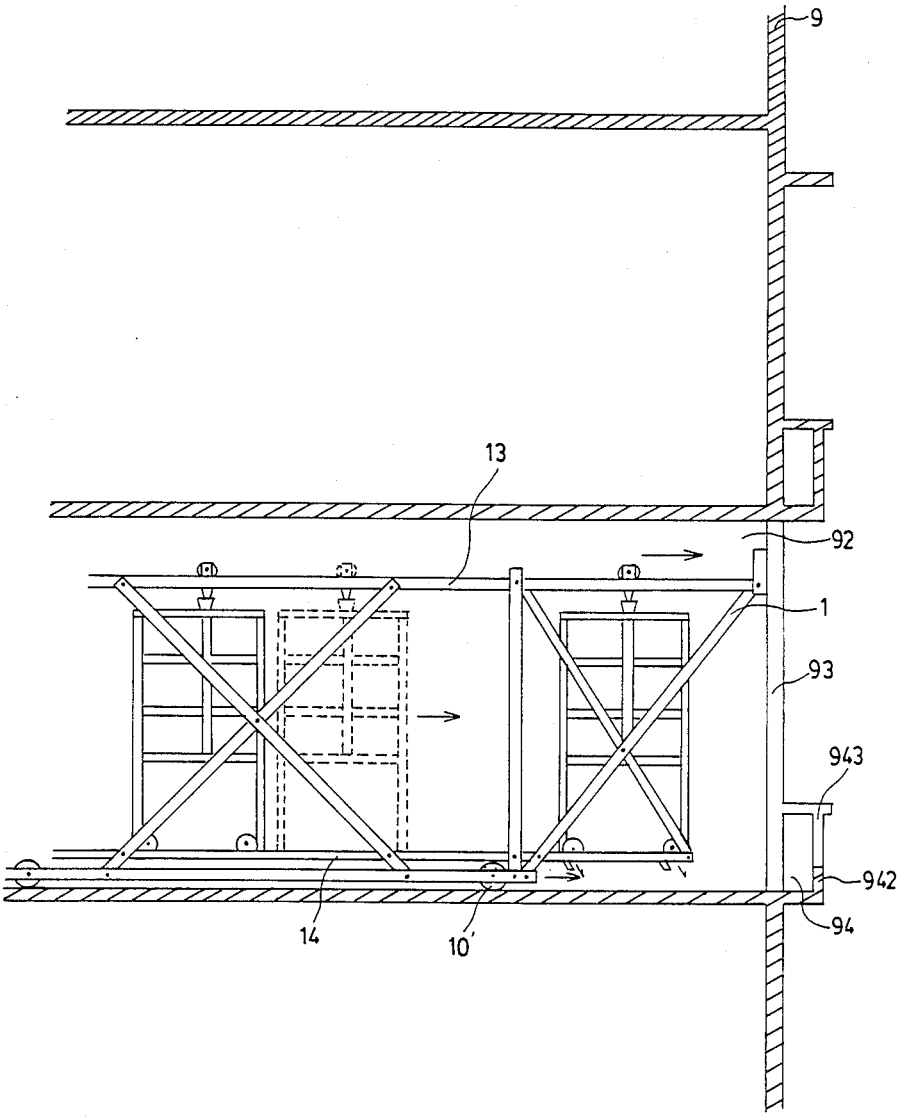
FIG. 16 is a schematic drawing illustrating the installation of a fire escape device of the present invention in a fire escape room at an intermediate floor of a high-rise building.

The fire escape device of the present invention may be mounted on any floor of a high-rise building. As illustrated in FIG. 16, a fire escape room (92) is set on a preferred floor of a high-rise building at a suitable location which is not in the down stroke of the fire escape device mounted on the roof of the high-rise building. A fire exit (not shown) is made on the outer wall (93) of the fire escape room (92). An opening (943) is made on the rails (942) of the balcony or the like (94) which is disposed opposite to the fire escape room (92). Through the opening (943), the cabin (2) of the fire escape device in the fire escape room (92) may be pushed out. In other words, the fire escaping device is normally received in the fire escape room (92) to prevent from hanging outside which may interfere with the outward look of the building (9). Several pair of casters (10') are mounted on the basic bearing frame assembly (1) at the bottom so that the basic bearing frame assembly (1) may be pushed out of the fire escape room (92) through the fire exit to become stopped by the rails (942) of the balcony (94), with the upper and lower tracks (13, 14) projecting from the outer wall (93). Thus, the cabin (2) in the basic bearing frame assembly (1) can be pushed out for carrying people.

I claim:

1. A multiuser high-rise building fire escape device, including:

a basic bearing frame assembly being fixedly mounted on the roof of a high-rise building and having a main frame structure comprised of several pairs of long and short rods respectively connected through screw joint or welding process, an upper track and a lower track respectively made thereon and disposed in parallel with each other at different level; and several cabins respectively mounted on said tracks of said basic bearing frame assembly and controlled to slide thereon, each being comprised of a pair of side wall portions, a front wall portion, a back wall portion, a top wall portion and a bottom wall portion and defining therein an inner space divided by a division plate into an upper person carrying chamber and a lower control room, said cabins each being equipped with a manual-operated power transmission mechanism comprised of two wheel axles of different size being respectively mounted in said pair of side wall portions at a lower position transversely piercing therethrough for mounting thereon of a pair of pulley wheels respectively, a pair of bottom gear wheels being respectively mounted on said two wheels axles at one lateral side at a position in the inner side by the pulley wheels thereof, an upper gear wheel being set in the same side wall portion at an upper position in the mid-way between said two bottom gear wheels and manual controlled to rotate by a handwheel in the cabin, a closed chain mounted on said two upper gear wheels and said bottom gear wheel to rotate through a triangular course; a speed reducing gear, a double-groove cable reel, a motor assembly and a mid-way stop mechanism co-axially coupled together and received in said control room; a steel rope combination connected to said double-groove cable reel to wind theretround and bilaterally extending outward and turning upward through a pair of guide pulleys and said pair of side wall portions to further pass through a wheel carrier on the two parallel rails of said upper track to let the cabin be suspended from said basic bearing frame assembly; and a ladder door mounted on the front wall portion to control the access of said person carrying chamber.

2. The multiuser high-rise building fire escape device according to claim 1, wherein the upper track is a double-track line comprised of a pair of parallel rails, the lower track is a double-track line including two parallel sets of rails of which each set is comprised an inner rail, an intermediate rail and an outer rail, and the pulley wheels of the cabins are mounted on the rails of the upper track and the lower track, said inner and intermediate rails being respectively turning downward at the front end through an angle suitable for guiding the cabins for down stroke, wherein the turning points of the inner rails and the intermediate rails are respectively made according to the range between the front and rear pulley wheels of the cabins.

3. The multiuser high-rise fire escape device according to claim 1, wherein the two wheel axles of each cabin are made in different sizes respectively mounted in the pair of side wall portions of the cabin at a lower position transversely piercing therethrough, wherein the wheel axle near the front wall portion is shorter and made in size to match with the two inner rails of the double-track line, the wheel axle near the back wall portion is longer and made in size to match with the two middle rails of the double-track line.

4. The multiuser high-rise building fire escape device according to claim 1, wherein the ladder door is mounted on the access of the cabin at the side facing to the building to be alternatively rotated horizontally and vertically to open or close the access of the cabin and includes a first vertical shaft and a second vertical shaft defining therebetween a ladder, a transverse shaft fixedly set in the access spaced away from the bottom wall portion of the cabin and coupled with said first vertical shaft through a knuckle, said knuckle being mounted on said first vertical shaft at the bottom end permitting rotation of said first vertical shaft on its own axis or against said transverse shaft, an eye pin which includes an eye ring mounted on said first vertical shaft at an upper position being inserted through the horn-shaped opening of the hole of a holder plate which is mounted on the top wall portion of the cabin, said holder plate comprising a lock pin controlled by a pull ring and a spring to engage with the circular groove of said eye pin to further let said eye pin and said first vertical shaft be firmly secured thereto, said second vertical shaft comprising a semi-circular hook end at the bottom to engage with said transverse shaft when the ladder door is closed, a rope fixedly connected to said eye ring and extending therefrom through said holder plate and a pulley to connect to a pull handle in the cabin to let the ladder door be released to rotate downward through an angle of 90° relative to the front wall portion of the cabin or pulled up to close the access.

5. The multiuser high-rise building fire escape device according to claim 4, wherein the eye ring has a rope fixedly connected thereto, which rope extends from said eye ring passing through said holder plate and a pulley to further penetrate through the top wall portion into the associated cabin to connect to a pull handle through which the ladder door may be released to rotate downward through an angle of 90° relative to the front wall portion or pulled up to close the access.

6. The multiuser high-rise building fire escape device according to claim 1, wherein the two vertical shafts of the ladder door each comprises respectively an U-shaped plate at the top having a pivot arm connected thereto, which pivot arm will be automatically turning to a position in linear to the U-shaped plate, through the effect of gravity, and in an angle of 90° against the connected vertical shaft for hooking up a window or balcony or the like of a building at any floor, when the ladder door is released from the top.

7. The multiuser high-rise building fire escape device according to claim 1, wherein the ladder door comprises is comprised of a solid back wall, two raised side walls and a plurality of cross rods set between said two raised side walls.

8. The multiuser high-rise building fire escape device according to claim 1, wherein the speed reducing gear comprises a corrugated disc plate having a corrugated surface respectively made thereon at both sides and four projectiles in the center hole; a barrel having four notches thereon for insertion therein of said four projectiles respectively; a pair of shells forming a housing for receiving therein said corrugated disc plate and said barrel and being fixedly connected to said cable reel at one side by means of screw bolts, each comprising a flange having a plurality of holes thereon for setting therein of a steel ball, a T-shaped element, a spring and a block respectively; a pair of taper plates respectively mounted on said pair of shells pressing on said blocks, each comprising respectively a center hole and a tapered plane; four pieces each of L-shaped plates respectively mounted on said pair of shells at the four corners; and an U-shaped holder plate comprising two side arms having tapered planes thereon in reverse direction against the tapered planes of said two taper plates, said U-shaped holder plate being mounted on said pair of shells with its two side arms respectively set in the bilateral tracks defined between said L-shaped plates; and a fastening means made on said U-shaped holder plate and connected with a spring at the inner side of said U-shaped holder plate for securing thereto of a pull rod to control the operation.

9. The multiuser high-rise building fire escape device according to claim 1, wherein the motor assembly includes a motor comprising a motor shaft having a toothed portion made thereon, three planet pinions triangularly disposed to respectively engage with said toothed portion of said motor shaft, and a ring plate fixedly connected to the cable reel at the other side opposite to said speed reducing gear and having teeth made on the inner wall and engaged with said planet pinions at the outer side.

10. The multiuser high-rise building fire escape device according to claim 1, wherein the mid-way stop mechanism comprises a brake wheel having made thereon a V-shaped circular groove; a pair of C-shaped brake shoe holders forming a brake ring having V-shaped brake shoe invertedly made thereon respectively set in said V-shaped circular groove of said brake wheel; a base fixedly set in said control room for securing thereto of said brake ring; two bracing elements respectively screwed up with said pair of C-shaped brake shoe holders with the first bracing element inserted into the second bracing element for connection thereto of a control lever to force said pair of C-shaped brake holders to squeeze said brake wheel to further stop the rotation of said motor assembly so as to stop the moving of cabin during down stroke.

11. The multiuser high-rise building fire escape device according to claim 1, which is mounted on an intermediate floor of a high-rise building.

12. The multiuser high-rise building fire escape device according to claim 11, wherein the fire escape device is received in a fire escape room having a fire exit made on the outer wall, an opening being made on the rails of the balcony or the like which is disposed opposite to said fire exit, and wherein the fire escape device may be pushed out of said fire escape room through said fire exit to become stopped at said opening for sending down the cabin mounted thereon.

* * * * *